US007452654B2

(12) United States Patent
Hirose et al.

(10) Patent No.: US 7,452,654 B2
(45) Date of Patent: Nov. 18, 2008

(54) TONER PRODUCTION METHOD AND TONER PRODUCTION APPARATUS

(75) Inventors: Naohiro Hirose, Hachioji (JP); Ken Ohmura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 484 days.

(21) Appl. No.: 11/233,701

(22) Filed: Sep. 23, 2005

(65) Prior Publication Data

US 2006/0160012 A1 Jul. 20, 2006

(30) Foreign Application Priority Data

Jan. 7, 2005 (JP) ..... 2005-002714

(51) Int. Cl.
*G03G 9/08* (2006.01)

(52) U.S. Cl. ..... 430/137.14; 430/137.15; 430/137.1

(58) Field of Classification Search ..... 430/137.14, 430/137.15, 137.1
See application file for complete search history.

(56) References Cited

U.S. PATENT DOCUMENTS

| | | | | |
|---|---|---|---|---|
| 5,468,586 | A * | 11/1995 | Proper et al. | 430/137.1 |
| 2002/0142243 | A1 * | 10/2002 | Hirose et al. | 430/110.3 |
| 2004/0137347 | A1 * | 7/2004 | Yamazaki et al. | 430/100 |

FOREIGN PATENT DOCUMENTS

| | | |
|---|---|---|
| JP | 2001-214629 | 8/2000 |
| JP | 2000-250263 | 9/2000 |
| JP | 2001-005219 | 1/2001 |

* cited by examiner

*Primary Examiner*—John L Goodrow
(74) *Attorney, Agent, or Firm*—Lucas & Mercanti, LLP

(57) ABSTRACT

A toner production method includes the step of: controlling a shape of toner particles in a shape controlling region to control the shape of toner particles in a water based medium, wherein the shape controlling region has a toner channel for the toner particles and a temperature controller capable of controlling at least two zones.

11 Claims, 6 Drawing Sheets

TONER PRODUCTION METHOD AND TONER PRODUCTION APPARATUS

This application claims priority from Japanese Patent Application No. 2005-002714 filed on Jan. 17, 2005, which is incorporated hereinto by reference.

BACKGROUND OF THE INVENTION

The present invention relates to a toner production method and a toner production apparatus.

Heretofore, has been useful as a toner constituting an electrostatic image developing agent, a so-called coalescence toner, which is produced employing an emulsion coalescence method (refer, for example, to Patent Document 1 or Patent Document 2).

Coalescence toners exhibit excellent characteristics in which the particle size distribution is narrow and the shape of toner particles is uniform. Further, due to its production processes, it is possible to control the shape of toner particles within a wide range, namely from a sphere to irregular shapes. Consequently, since excellent electrification properties, transferability, and cleaning properties are achieved, it is possible to apply the above toner to a high speed image forming apparatus.

However, in regard to the coalescence toner, it is somewhat problematic to produce one exhibiting the desired particle size distribution and shape at high accuracy during its mass production. In order to overcome the above drawbacks, various techniques are known (refer, for example, to Patent Document 3). However, sufficient desired effects have not been attained even employing these techniques.

Specifically, when employed as a non-magnetic single component developer, toner particles, the shape of which approaches a sphere, enables static electrification to be higher. However, the range of the allowed particle shape is markedly narrowed due to the relationship of conveying properties to the development region and cleaning properties.

On the other hand, developed have been technologies to produce toner capable of appropriately being employed as a low temperature fixed toner employing an emulsion coalescence method. In order to provide the resulting coalescence toner with characteristics suitable for a low temperature fixed toner, when, as toner materials, toner resins at a softening point of 100° C. or less, as well as releasing agents and fixing aids at a melting point of 80° C. or less are employed, the variation range of the shape of toner particles, in the process to control the shape of toner particles, is broadened. Namely, as particles become sensitive, problems occur in which it is difficult to control the shape of toner particles resulting in high accuracy.

Further, in the production processes of the coalescence toner, commonly employed as a reaction apparatus is a so-called reaction vessel which is structured in such a manner that, for example, a heat-exchange jacket is arranged on the outer periphery as well as in the interior, stirring blades are arranged. In the production method employing the above reaction vessel, problems occur in which the cycle to heat and cool the reaction vessel results in large energy loss and thereby low heating and cooling efficiency.

In addition, demanded is a production method which retards discharge of carbon dioxide gas while enhancing productivity.

(Patent Document 1) Japanese Patent Publication for Public Inspection (hereinafter referred to as JP-A) No. 2000-214629

(Patent Document 2) JP-A No. 2000-250263

(Patent Document 3) JP-A No. 2001-5219

SUMMARY OF THE INVENTION

In view of the foregoing, the present invention was achieved. An object of the present invention is to provide a production method of a toner capable of forming high quality images, and a toner production apparatus.

Another object of the present invention is to provide a toner production method and a toner production apparatus which exhibit high energy consumption efficiency and controlled discharge of carbon dioxide gas.

The above objects are achieved employing any one of Items (1)-(13) below.

Item (1): A toner production method comprising at least a shape controlling process which controls the shape of toner particles, wherein said shape controlling process comprises a shape controlling process region to control the shape of toner particles in a water based medium, and said shape controlling process region comprises a toner channel and a temperature controlling means capable of controlling at least two zones.

Item (2): The toner production method described in Item (1), comprising a coalescence process which further forms toner particles on the upstream side of said shape controlling process, wherein said coalescence process comprises a coalescence process region to form toner particles by coalescing resinous particles in a water based medium, said coalescence process region comprises a toner channel which positions on the upstream side of the toner channel of the shape controlling process and a means capable of controlling at least two zones.

Item (3): The toner production method described in Item (1), comprising a polymerization process which further performs a polymerization reaction on the upstream side of said shape controlling process, wherein said polymerization process comprises a polymerization performing region in which polymerization reaction of at least a polymerizable monomer and a colorant which are continuously fed into the toner channel is performed.

Item (4): The toner production method described in Item (3) wherein said polymerization performing region comprises a temperature controlling means capable of controlling at least two zones.

Item (5): The toner production method described in Item (2) comprising a polymerization process which further performs a polymerization reaction on the upstream side of said coalescence process, wherein said polymerization process comprises at least a polymerization process region in which at least a polymerizable monomer is continuously fed so that a polymerization reaction is performed.

Item (6): The toner production method described in Item (5) wherein said polymerization process comprises a polymerization process region in which the polymerization reaction of at least a polymerizable monomer, which is continuously fed into the toner channel, is performed.

Item (7): The toner production method described in Item (5) or (6) wherein said polymerization process region comprises a temperature controlling means capable of controlling at least two zones.

Item (8): The toner production method described in Item (6) wherein at least a pigment is continuously fed into the toner channel located between said polymerization process and said coalescence process.

Item (9): The toner production method described in Item (2) wherein a toner shape controlling process initiates by feeding an aggregation inhibiting agent into the toner channel located between said coalescence process and said shape controlling process.

Item (10): The toner production method described in any of Items (1)-(3) wherein a toner channel branches into a plurality of parallel channels, and if desired, these branched channels may merge.

Item (11): The toner production method described in any of Items (1)-(7) wherein a toner channel, which spirally extends in the centripetal direction, is double-spirally arranged with the heating medium passing channel which is adjacent to said toner channel via a spacer which extends in the centrifugal direction.

Item (12).: The toner production method described in any of Items (1)-(5) wherein in a shape controlling process region of the toner channel, a sampling means to measure particle diameter and shape coefficient is arranged, and the temperature of the toner channel is controlled based on the measured results of said particle diameter and shape coefficients, employing a temperature controlling means.

Item (13): The toner production apparatus comprising at least a shape controlling process which controls the shape of toner particles wherein said shape controlling process comprises a shape controlling process region to control the shape of toner particles in a water based medium, and said shape controlling process region comprises a toner channel and a temperature controlling means capable of controlling at least two zones.

DETAILED DESCRIPTION OF THE PREFERRED EMBODIMENTS

The present invention will now be detailed.

The toner production method of the present invention is characterized in incorporating a shape controlling process region to control the shape of toner particles in a water based medium, and a shape controlling process which controls the shape of toner particles in the toner channel in which a temperature controlling means is arranged capable of controlling at least two zones in the above shape controlling process region.

A specific example of the toner production method of the present invention includes a method to produce a coalescence toner employing an emulsion coalescence method. Listed, for example, are the following techniques (1) and (2).

As used herein, an "emulsion coalescence method" refers to a method in which an emulsified resinous particle dispersion is coalesced and further fused to form toner particles. It is preferable that coalescence is performed in conjunction with fusion. However, another method is possible in which when resinous particles are temporarily coalesced and the resulting particle diameter reaches the desired value, coalescence is performed at once while applying heat.

Further, as used herein, "shape control of toner particles" refers to the process in which spherical or irregular shape is formed after no particle diameter change is noted, and specifically refers to a process to control the shape of toner particles after resinous particles are coalesced, or coalesced and fused.

Figure 6:
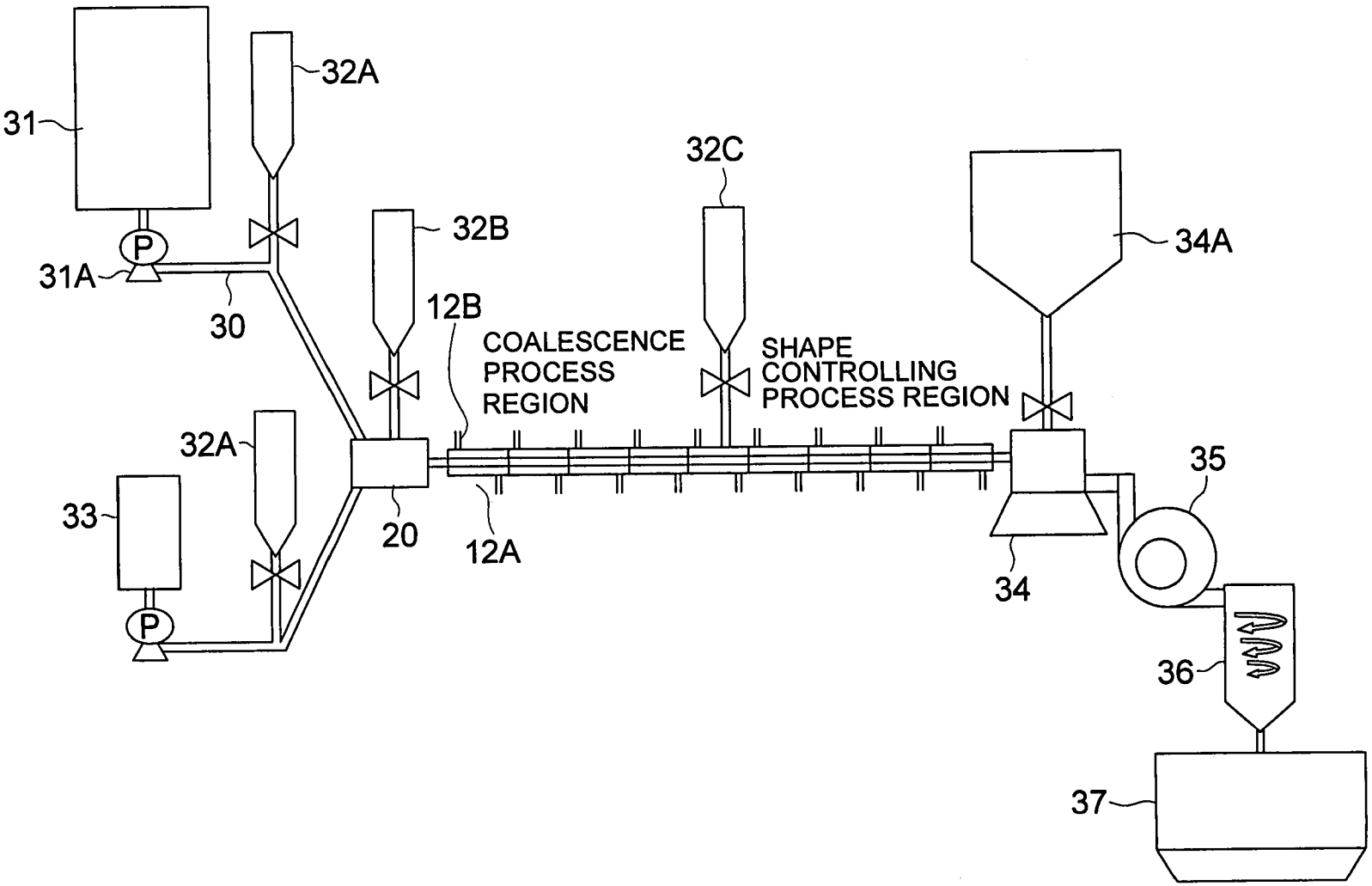
FIG. 6 is an explanatory schematic view showing one example of the constitution of a toner production apparatus employed in the toner production method of the present invention.
Figure 7:
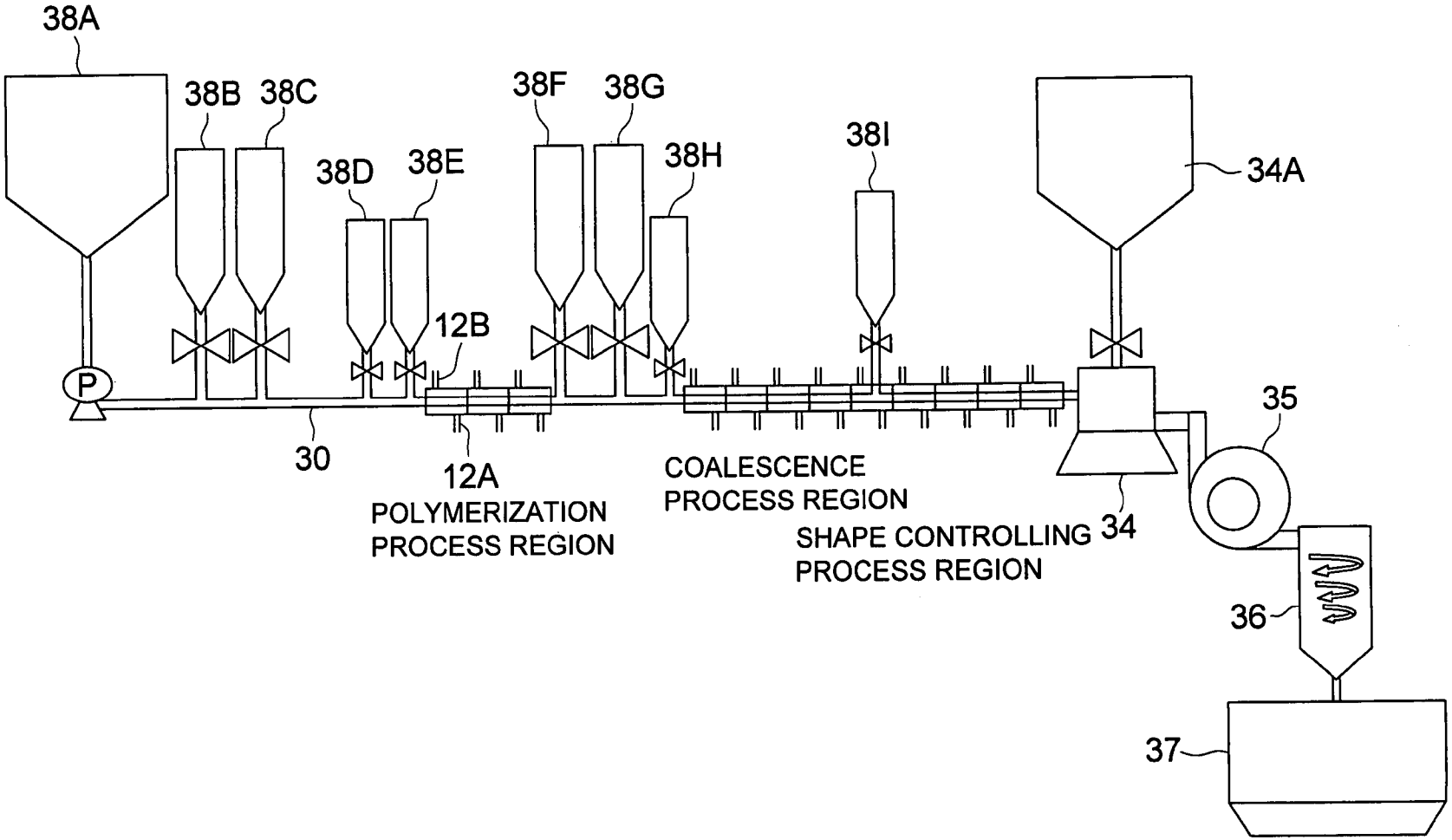
FIG. 7 is an explanatory schematic view showing another example of the constitution of a toner production apparatus employed in the toner production method of the present invention.

Namely, irregularly coalesced particles are subjected to heating over a definite duration so that the resulting shape approaches a sphere utilizing the phenomenon of surface tension. Commonly, prior to reaching a perfect sphere, shape change is terminated by cooling and the resulting shape is fixed. Alternatively, heat and stirring are applied to toner particles so that those which are nearly spherical are converted to a nearly irregular shape. As used herein, "stirring" refers to an operation in which shearing force is applied to toner particles via a water based medium employing a stirring member, and includes an operation in which toner particles are allowed to pass through a narrow channel at a high rate which results in a changed shape of particles. (1) A technique (hereinafter also referred to as the "first technique") in which a coalescence process and shape controlling process occur in a toner channel in such a manner that as shown in FIG. 6, polymerization reaction products which are obtained via a polymerization reaction in a stirring type reaction vessel fitted with stirring blades are introduced as a toner material into the above toner channel. (2) A technique (hereinafter also referred to as the "second technique") which collects from a toner channel a toner particle dispersion which has been prepared in such a manner that as shown in FIG. 7, polymerizable monomers and colorants as a toner material are continuously fed into the above toner channel and are allowed to pass polymerization process performing a polymerization reaction and subsequently a shape controlling process performing shape control.

The toner channel, as described herein, which is employed in the toner production method of the present intention, refers to a space capable of conveying toner particles in a water based medium, namely a dispersion.

Specific embodiments include a piping and are shaped similarly to a rainwater pipe.

Figure 1:
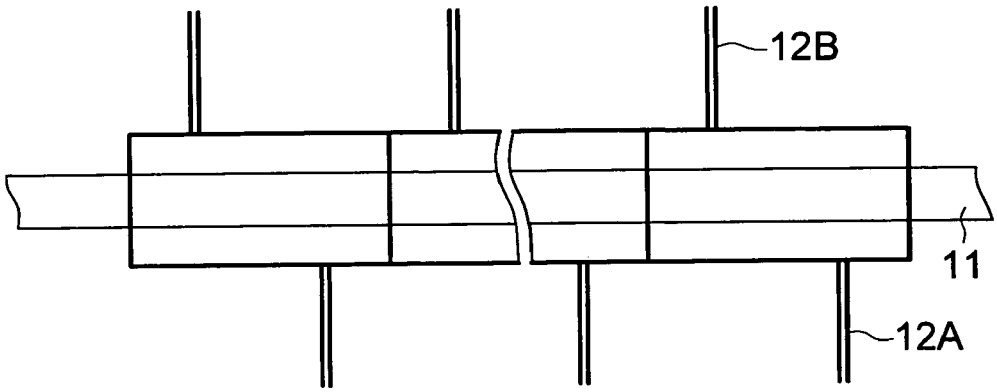
FIG. 1 is an explanatory view showing one example of the constitution of a toner channel employed in the toner production method of the present invention.
Figure 2:
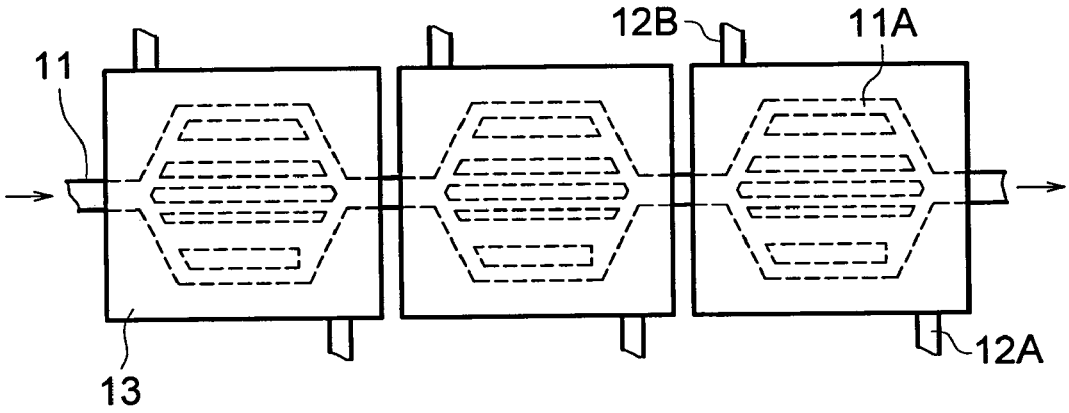
FIG. 2 is an explanatory view showing another example of the constitution of a toner channel employed in the toner production method of the present invention.

Zone control, as described herein, means that the channel of a toner particle dispersion is branched so that the temperature of the branched region is independently controlled at a specified value via heating or cooling. The number of zones may be optionally determined depending on temperature gradient, but is preferably 2-200 per 10,000 mm channel. Specific embodiments of the zone control follow. For example, as shown in FIG. 1, preferred is piping 11 which is arranged in such a manner that it is possible to flow a heat medium to the surroundings via heat medium inlets 12A and heat medium outlets 12B. In order to enhance heat exchange effectiveness, a more preferred arrangement is such as shown in FIG. 2, where heat medium 13 is allowed to flow to surroundings and piping 11 is branched into a plurality of channels 11A which are arranged in parallel.

Figure 3:
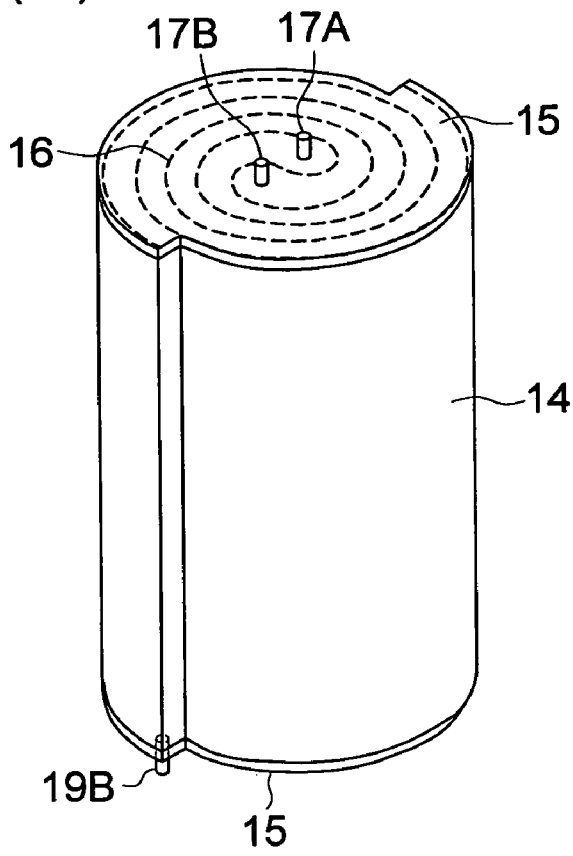
FIGS. 3(*a*) and 3(*b*) is explanatory views showing still another example of the constitution of a toner channel employed in the toner production method of the present invention, while FIG. 3(*a*) is its perspective view and FIG. 3(*b*) is its sectional view.
Figure 3:
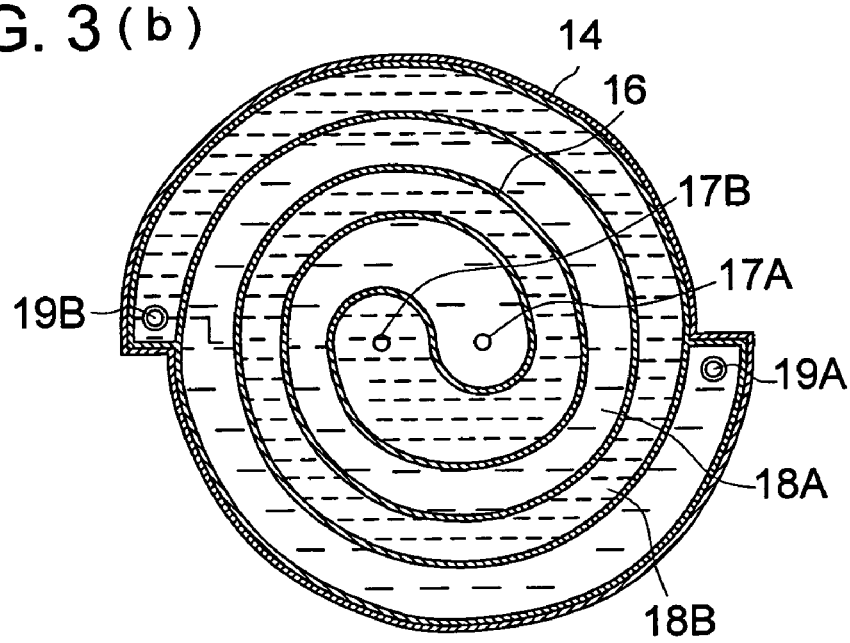

Alternatively, as shown in FIGS. 3(*a*) and 3(*b*), employed as a toner channel may be one which is constituted as a heat exchanger having an inlet and outlet and is arranged as a double spiral with a heating medium passing channel which spirally extends in the centripetal direction and is adjacent said toner channel via a spaced board which extends in the centrifugal direction.

The heat exchanger channel shown in FIGS. 3(*a*) and 3(*b*) is housed in a sealed cylinder and is structured in such a manner that its peripheral surface is covered with protective layer 14 composed of thermal insulating materials and its upper surface and bottom surface are sealed employing end plates 15. In the cylinder interior surrounded by protective layer 14 and two end plates 15, first channel (being a toner channel) divided by spacer 16 composed of a looped metal plate, which is employed to pass toner materials is arranged as a double spiral with second channel 18B which is employed to pass heat media while they come into contact with each other.

In this apparatus, inlet hole 19A which leads to first channel 18A and inlet hole 19B which leads to second channel 18B are formed on the outer edge of one of end plates 15, while outlet hole 17A which leads to first channel 18A and outlet hole 17B which leads to second channel 18B are formed in the central portion of the other end plate 15.

Employed as heat media may be water, steam, polyethylene glycol, and silicone oil. Further, instead of heating media, it is possible to use coolants. Employed as coolants may be R22 (methane based, molecular formula: $CHClF_2$, molecular weight: 86.47, boiling point: −40.82° C.); R142b (ethane based, molecular formula: $CH_3$—$CClF_2$, molecular weight: 100.50, boiling point: −9.8° C.); and C318 (cyclic fluorinated cyclobutane, chemical formula: $C_4H_8$, molecular weight: 200.03, boiling point: −5.85° C.).

Pipes which constitute the toner channel preferably have an internal diameter of 1-50 mm and a thickness of 0.5-3.0 mm.

Further, the total length of pipe is appropriately determined depending on the internal diameter and thickness of the above pipes, the type of toner materials, and the feeding rate and amount of toner materials. Specifically, it is preferable that the total length of a shape controlling process region is 10,000-120,000 mm, the total length of the region which performs coalescence is 10,000-95,000 mm, and the total length of the polymerization processing region is 10,000-60,000 mm.

Preferably employed as pipe material of may, for example, be stainless steel or nickel alloys, while it is also possible to employ, for example, resins and rubber.

In view of washability and extended life of these devices, it is preferable that the internal surface of pipes is subjected to glass lining or coating of tetrafluoroethylene or silicone resins.

The preferable feeding rate of toner materials in such a toner channel is such that the flow rate of fluid in the above toner channel is commonly 0.005-5.000 m/second. Specifically, the flow rate of fluid in the shape controlling process region is preferably 0.007-3.000 m/second. Particularly, in cases in which shape changing operation of toner particles in the shape controlling process is performed only by passing toner particles through the toner channel, it is preferable that the flow rate of fluid in the above toner channel is 0.007-2.000 m/second.

A temperature controlling device arranged in the toner channel performs zone control in such a manner that the shape controlling process region is divided and zone control is performed in which the temperature of the divided region is independently controlled to the specified temperature by heating or cooling. It is possible to optionally determine the number of divided regions (being zones) depending on temperature gradient, but it is preferable that 2-20 regions are arranged per 10 m of the toner channel. In cases in which it is desired that no temperature gradient is applied, the temperature of the zone in contact may be set at the same temperature.

Specifically, in the example of FIG. 2, three independent zones, each of which is fitted with heat medium inlets 12A and heat medium outlets 12B, are shown.

In the toner channel, is arranged a mixing device, to perform, for example, a mixing process or a dispersing process which is applied to the toner materials fed into the above toner channel.

Employed as mixing devices may be those such as a high speed shearing type homogenizer or a static in-pipe mixer. It is possible to employ at least two types of these devices in combination.

Figure 4:
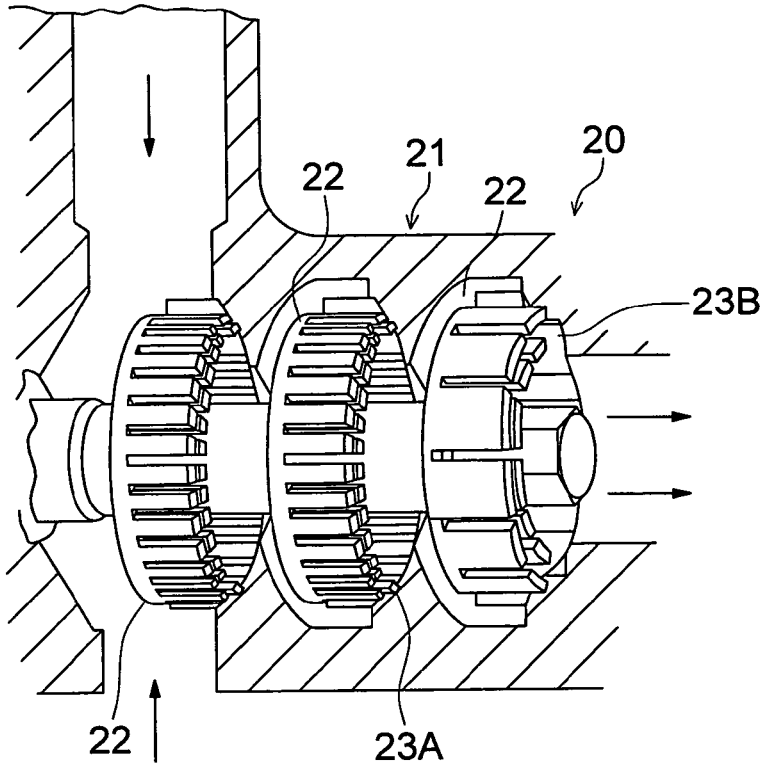
FIG. 4 is an explanatory view showing one example of the constitution of a high speed shearing type homogenizer as a mixing means employed in the toner production method of the present invention.

Listed as a specific example of the high speed shearing type homogenizer is one which is constituted in the manner shown in FIG. 4, in which three liquid shearing mechanisms 20 which are provided with basket type stator 23A, having numerous slits in its wall and high speed rotating rotor 23B which is concentrically arranged in a built-in state into above stator 23A are aligned in series.

In such high speed shearing type homogenizer 20, toner materials charged into above high speed shearing type homogenizer initially flow into the liquid shearing mechanism and successively pass through each of the slits of the stator and rotor constituting the first liquid shearing mechanism, and flow into the second liquid shearing mechanism and the third liquid shearing mechanism in the above order. In a process of passing through the slit of each of the stator and the rotor, a dispersing process is performed and finally discharge is performed via an outlet channel.

Figure 5:
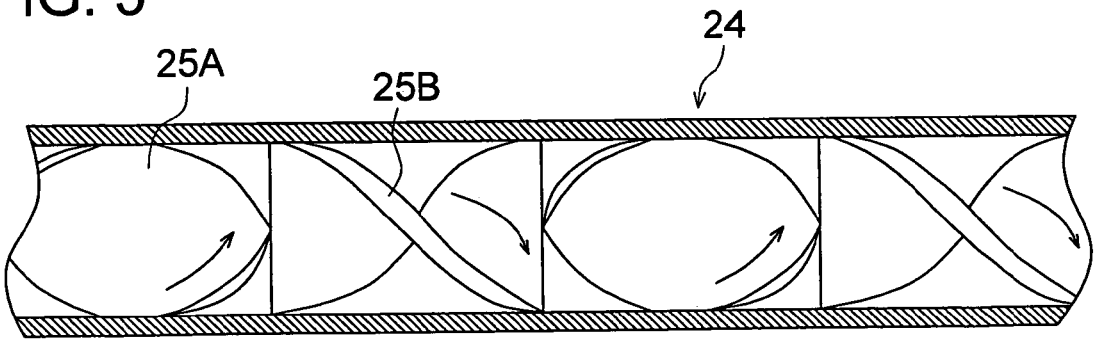
FIG. 5 is an explanatory view showing one example of the constitution of a stationary in-pipe mixing device as a mixing means employed in the toner production method of the present invention.

Listed as a specific example of the above static in-pipe mixer is one which is constituted in the manner shown in FIG. 5. A pipe, one end of which is used as an inlet (not shown) and the other end of which is used as an outlet (not shown) is provided, and in the above pipe, guiding plate 25 which revolves to the right along the central axis line while dividing the cross-section of the pipe into two and guiding plate 25B which revolves to the left are alternately arranged in the direction along the central axis line.

In such static in-pipe mixer 24, toner materials charged into one end of the pipe are subjected to a mixing process by repeated division and revolution during steps passing two types of he guiding plates, and is finally discharged from the other end of the above pipe.

An example of the production method of coalescence toner is constituted of processes (1)-(5) below, and if desired, may also include process (6).

(1) A dispersion process in which a monomer solution is prepared employing polymerizable monomers and the resulting monomer solution is dispersed into a water based medium.

(2) A polymerization process to prepare a resinous particle dispersion (being a latex) in such a manner that if desired, water-soluble polymer initiators are added to the resulting water based dispersion of the monomer solution and the resulting mixture undergoes polymerization.

(3) A coalescence process which prepares toner particles (coalesced particles) which are prepared by coalescing and fusing the resulting toner particles in a water based medium.

(4) A shape controlling process which controls the shape of toner particles.

Specifically, after almost complete coalescence and fusion, it is possible to control the shape by further stirring while heated. Commonly, the shape approaches a sphere employing the phenomenon of surface tension. The shape of toner particles gradually approaches a sphere, but when the desired shape (desired circularity) is achieved, the resulting toner particles are cooled to terminate shape change and are fixed. Alternatively, heating and stirring are applied to toner particles, whereby those which are relatively spherical approach an irregular shape.

(5) A solid-liquid separation and drying process in which after controlling toner particles to the desired shape, a solid-liquid separation process is performed employing a centrifugal dehydrator and simultaneously washing is performed, and subsequently, a drying process is performed, whereby dried powder, namely dry toner, is prepared.

(6) An external additive addition process which adds external additives to the dry toner particles.

Specifically, silica and inorganic oxide particles are added, and external additives are added and mixed employing Henschel mixer, whereby the desired fluidity is provided.

In a toner production apparatus, each of these processes is performed in the following regions; process (2) is performed in the polymerization process region, process (3) is performed in the coalescence process region, and process (4) is performed in the shape controlling region.

Employed as toner components used in the production method of coalescence toners may be polymerizable monomers, as well as, if desired, colorants, releasing agents, fixing aids, resins which are employable upon being dissolved in water, and charge controlling agents.

Employed as polymerizable monomers may be polymerizable vinyl monomers. Specific examples include styrene, butyl acrylate, 2-ethylhexyl methacrylate, and methyl methacrylate.

Further, it is preferable that compounds having an ionic dissociation group, such as methacrylic acid, are incorporated in an amount of 1-10 percent by weight. In addition, employed may be crosslinking agents known in the art such as divinylbenzene.

Employed as colorants may be those known in the art. However, not suitable are those which exhibit an abnormal increase in viscosity when dispersed into a water based media.

Specific examples of preferred colorants include carbon black, monoazo yellow, bisazo yellow, quinacridone red, rhodamine red, carmine based pigments, naphthol based pigments, and phthalocyanine pigments.

Employed as releasing agents may be polyolefin waxes. Specifically employed are polypropylene, polyethylene, Fischer-Tropsch wax, and microcrystalline wax. Listed as synthetic ester waxes are behenyl behenate, (poly)glycerin stearic acid esters, and pentaerythritol myristic acid esters. Of these, preferred are pentaerythritol (tetra)stearic acid esters. Listed as natural waxes are carnauba wax, montan wax, coccid wax, and rice wax.

Listed as fixing aids are vinyl polymer oligomers at a peak molecular weight of 2,000-3,000 and a glass transition point of at most 30° C.; dipodic acid; aliphatic multivalent carboxylic acid esters such as dimethyl adipate, diethyl adipate, dibutyl adipate, or di-2-ethylhexyl adipate; aliphatic polyhydric alcohol esters such as ethylene glycol diacetate, ethylene glycol dibutyrate, polyethylene glycol diacetate, triethylene glycol disebacate, propylene glycol diacetate, polypropylene glycol diacetate, glycerin triacetate, or glycerin tributyrate; aliphatic oxy acid esters such as methyl acetylricinolate, propyl acetyllicinolate, butyl acetyllicinolate, or acetyltributyl citrate; aliphatic polyether polyhydric carboxylic acid esters such as dimethyldiglycol succinate, diethyldiglycol succinate, dipropyldiglycol succinate, dimethyldiglycol adipate, diethyldiglycol adipate, dipropyldiglycol adipate, or dibutyldiglycol adipate; polyhydric alcohols such as diglycerin, polyglycerin, trimethylolethane, trimethylolpropane, pentaerythritol, ethylene glycol, propanediol, butanediol, hexanediol, polyethylene glycol, 3-methylpentane-1,3,5-triol, xylit, xylol, arabit, adonit, mannit, sorbit, or dulcit, or higher fatty acid esters thereof, and addition products which-are prepared by adding ethylene oxide or propylene oxide to those; as well as PVA based resin plasticizers such as urea derivatives, including ethylene urea. Of these, preferred are aliphatic oxy acid esters such as methyl acetyl licinolate, propyl acetyllicinolate, or butyl acetyllicinolate, acetyltributyl citrate, as well as aliphatic polyether polyhydric carboxylic acid esters such as dimethylglycol succinate, diethylglycol succinate, dipropyldiglycol succinate, dimethyldiglycol adipate, or dibutyldiglycol adipate.

The added amount of fixing aids is preferably in the range of 1-20 parts by weight, but is more preferably in the range of 4-15 parts by weight.

Listed as usable resins other than vinyl polymers are polyester resins, urea-modified polyester resins, urethane-modified polyester resins, crystalline polyester, polyol resins, polylactic acid resins, and acetate resins. These are dissolved in polymerizable vinyl monomers and then undergo polymerization. Alternatively, they may be dissolved in solvents to form a resinous solution which is dispersed into a water based medium, followed by removal of the solvents.

Employed as charge controlling agents may be acrylamidosulfonic acid or calixarene, as well as other charge controlling agents known in the art.

The toner production method of the present invention will now be described with reference to FIG. 6.

FIG. 6 is an explanatory schematic view showing an example of the constitution of a toner production apparatus employed in the toner production method of the present invention. In more detail, FIG. 6 is a schematic view of an apparatus which is structured in such a manner that a polymerization process, and a colorant dispersing process which disperses colorants into a dispersing water based medium, are performed in conventional equipment and toner production is performed in a toner channel employed as a coalescence process region and a shape controlling process region, specifically in a channel provided with a temperature controlling device capable of controlling at least two zones.

By employing the above toner production apparatus, a coalescence toner is produced employing the first technique.

In stirring vessel reactor 31 (hereinafter also referred to as a "reaction tank") incorporating stirring blades, mini-emulsion polymerization and emulsion polymerization are performed in two stages in the presence of releasing agents, whereby a resinous particle dispersion is prepared. The resulting resinous particle dispersion is pumped into toner channel 30 employing pump 31A. Subsequently, solid concentration is controlled to 10-30 percent employing water for dilution.

Toner channel 30 may not be reaction tank 31 itself, but may be connected to a resinous particle dispersion tank or to a solvent containing resinous solution particle tank. However, in this case, it is preferable that a submerged drying device which distills out solvents in a water based medium is installed before solid-liquid separation apparatus 34 is introduced.

On the other hand, in stirring mixing device 33, colorants are dispersed into an aqueous surface active agent solution. In the same manner as for resinous particles, water for dilution is fed from tank 32A and appropriate dilution is performed. Thereafter, the channel of the resinous particle dispersion and the channel of the colorant dispersion merge. At the merging point, arranged is high speed shearing type homogenizer 20, wherein colorant particles and resinous particles are mixed. Further, coagulants are added from tank 32B. Specifically employed as coagulants are aqueous solutions of divalent or trivalent metal salts.

Thereafter, the coalescence process commences. Starting from the coalescence process, temperature controlling devices capable of performing zone control are installed, and the temperature is gradually raised based on the temperature set for each zone. The final temperature is 70-98° C.

Along with the progress of aggregation, when the diameter of toner particles reaches the desired value, namely the volume average particle diameter reaches 4-9 μm, aggregation inhibitors are fed from tank 32C. Aggregation inhibitors are preferably an aqueous solution of univalent metals or organic acid metal salts, but cationic surface active agents also are usable. Alternatively, excessive dilution may be performed employing ion-exchanged water.

Subsequently, toner channel 30 enters the shape controlling process region. The suitable processing temperature of the shape controlling process is 85-98° C. when the softening of the toner is at least 105° C.

If the softening point of the toner is less than 105° C., the temperature is preferably 20-30° C. lower than the softening point of the toner. It is possible to estimate the softening point of the toner by determining the softening point of sampled resinous particles.

The desired shape formation is achieved before toner channel 30 enters solid-liquid separation device 34 and by cooling the resulting toner particles to normal temperature, the shape of toner particles remains the same.

A plurality of solid-liquid separation devices 34 may be employed. For example, water based solvents of toner particle dispersion are removed employing a centrifugal dehydrater fitted with filters, and subsequently, washing is completed by showering washing water from tank 34A into the dehydrater.

When the solid-liquid separation process is completed, toner particles form a solid material called a toner cake or a wet paste, which contains water in an amount of 10-30 percent, and the resulting solid material is fed into dryer 35. A drying process is performed until the water amount reaches less than 2.0 percent but preferably less than 1.0 percent. The dried material is recovered in powder tank 37 employing powder recovery device 36.

Thereafter, if required, the resulting powder is conveyed to an external additive addition process (not shown) and is subjected to adhesion, or anchoring, of the above external additives.

The production method of the toner of the present invention will now be described with reference to FIG. 7.

FIG. 7 is an explanatory schematic view showing another example of the constitution of a toner production apparatus employed in the toner production method of the present invention. In more detail, the above apparatus is an improved one of the toner production apparatus in FIG. 1, and a temperature control device capable of controlling at least two temperature zones controls of the shape controlling process region is provided. FIG. 7 is a schematic view of the apparatus which is constituted in such a manner that toner production is performed in the polymerization process region of the toner channel positioned upstream of the shape controlling process region; on the way, a colorant dispersion is added; and of course, the temperature control device capable of controlling at least two temperature zones in the coalescence process region and shape controlling process region is arranged.

By employing the above toner production apparatus, coalesced toner is produced employing the second technique.

Initially, a water based medium, specifically an aqueous surface active agent solution, is introduced to toner channel 30 from tank 38A, while polymerizable monomers such as styrene or butyl acrylate are introduced into toner channel 30 from each of tanks 38B and 38C.

If desired, plasticizers as a fixing aid may also be added. It is preferable that, though not shown, emulsification is performed by arranging high speed shearing homogenizer 20 at the merging point of the water based medium with the polymerizable monomers. Subsequently, chain transfer agents and initiators are added from each of tanks 38D and 38E. Addition order of the polymerizable monomers, chain transfer agents, and initiators may be selected to match the type of reaction, and needless to say, the order is not limited to the one in FIG. 7.

Subsequently, the temperature of droplets of the polymerizable monomers is raised to the polymerizable temperature such as 65-80° C. After completion of reaction, the temperature is lowered to, at most, the glass transition point.

When polymerization is completed, a colorant dispersion and a releasing agent dispersion are introduced to toner channel 30 from each of tanks 38F and 38G, and subsequently, an aqueous coagulant solution is added from tank 38H.

Herein, it is preferable to arrange high speed shearing type homogenizer 20 or static in-pipe mixer 24 at the merging point of the channels.

Subsequently, toner channel 30 enters a coalescence process. When polyhydroxylated aluminum or trivalent metal salts are employed as a coagulant, toner particles are aggregated to reach the specified diameter via precise adjustment of the aggregation temperature.

Thereafter, the temperature of the coalescence process is controlled to approximately the glass transition point, specifically 35-55° C. of the resinous particles, whereby coalesced particles are stabilized.

Subsequently, in order to cover or modify the surface of toner particles, it is preferable that a resinous particle dispersion is again added from tank 38I. One of the purposes is to improve electrification property by covering colorant particles or releasing agent particles existing on the surface of the toner particles. Another purpose is to modify the surface of toner particles, employing a method which perform modification using charge controllable resinous particles or particles which exhibit high heat resistant retention property (the glass transition point is 5-50° C. higher).

Thereafter, the toner channel enters a shape controlling process and reaches a shape controlling process region provided with a temperature controlling device capable of controlling at least two temperature zones. At the time, the temperature of the shape controlling process is raised to at least the glass transition point and also exhibits a function in which particles which have been relatively loosely aggregated are coalesced.

In the shape controlling process, arranged is a device to collect a sample which is employed to determine the diameter and shape coefficient of toner particles. It is preferable that temperature control is performed based on the determined results of the diameter and shape coefficient of the toner particles employing the temperature controlling device. In the present example, it is preferable to monitor the shape and particle diameter by performing the installation of a sampling channel. When reached to the desired particle system, cooling is performed to at most the glass transition point of the previously polymerized resinous particles. Thereafter, in the same manner as the toner production apparatus of FIG. 6, performed are solid-liquid separation, washing, drying, and if desired, blending of external additives.

In the above, the toner production method of the present invention is described, as a specific example, with reference to techniques to produce a coalescence toner employing an emulsion coalescence method. However, the toner production methods of the present invention are not limited thereto, and as another specific example, listed is a method to produce a chemical toner employing a technique which does not employ a coalescence process.

Figure 8:
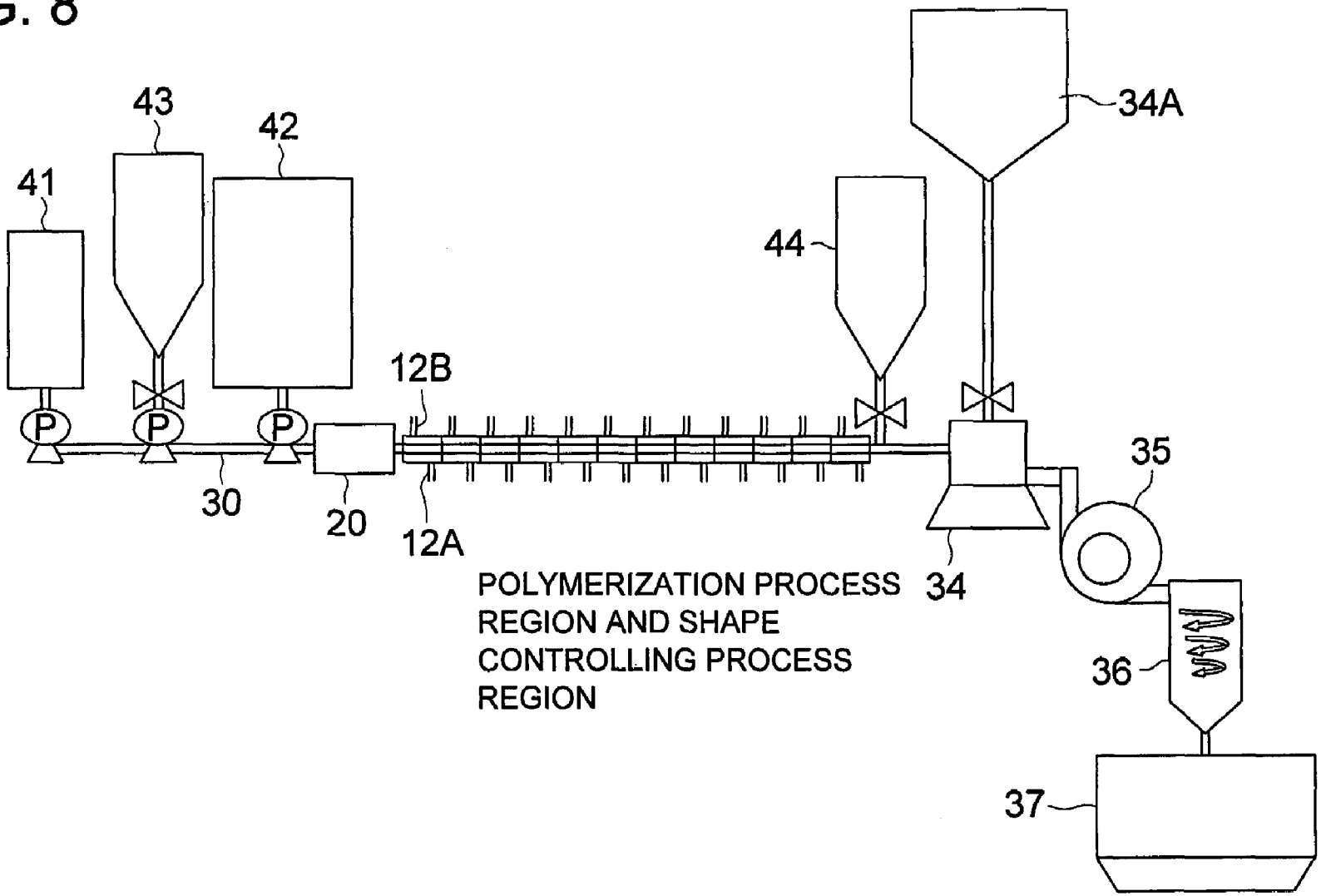
FIG. 8 is an explanatory schematic view showing still another example of the constitution of a toner production apparatus employed in the toner production method of the present invention.

Shown specifically in FIG. 8, is an example of the constitution of a toner production method to perform shape control in a chemical toner production method performing no coalescence process.

In this example, a suspension polymerization is exemplified, but it is possible apply it to toner of a dissolution suspension method employing a resinous solution using solvents.

Initially, tank 41 containing water based medium, in which water insoluble colloids, such as calcium phosphate, is dispersed, is connected to toner channel 30.

Subsequently, charged into tank 42 is a polymerizable monomer solution which is prepared by dispersing necessary internal additives such as colorants and releasing agents into the polymerizable monomers. Subsequently, the above tank solution is introduced into toner channel 30 and a polymerization initiator is also fed from tank 43. Immediately after that, the resulting mixture is passed through a stirring device as shown by high speed shearing type homogenizer 20, whereby droplets at a size approximately the same as the toner particle size are formed and a polymerization reaction is performed. Targeting a polymerization addition ratio of at least 20 percent, a stirring member such as static pipe mixer 34 is arranged in toner channel 30. Since heat and shear force stress due to stirring are applied to toner channel 30, toner particles result in a shape, having major and minor axes, which is different from a sphere. Subsequently, the reaction is terminated by introducing hydrochloric acid into toner channel 30 from tank 44. After achieving the desired shape, the same process is performed as for the toner production methods of FIGS. 6 and 7.

In the toner prepared employing the above production method, it is preferable that the volume based median diameter of toner particles is 3-9 μm, and the number based median diameter of toner particles is 2-7 μm, while the variation coefficient of the number based size distribution is 8-23.0 percent. Further, it is preferable that the distribution of at most 2 μm is less than 1.0 percent by number and the distribution of at least 15 μm is less than 0.6 percent by number.

As used herein, "volume based median diameter, number based median diameter, number based size distribution, and number variation coefficient" are determined employing COULTER COUNTER TA-11 or COULTER MULTISIZER, both produced by Coulter Co. In the present invention, COULTER MULTISIZER was employed and an interface (produced by Nikkaki Co.) which output a size distribution was employed via connecting to a personal computer. Employed as an aperture employed in the above COULTER MULTISIZER was one at 30 μm, and the volume and number of toner particles at 0.6 μm or more were determined and the size distribution as well as median diameters was calculated. Number size distribution, as described herein, refers to relative frequency of toner particles with respect to particle diameter, while the number based media diameter refers to the median diameter of the number particle size distribution. "Number variation coefficient in the number size distribution" of the toner is calculated based on the following formula:

Formula Number variation coefficient=$[S/D_n]\times 100$ (in percent)

wherein S represents average deviation in a number particle size distribution, while $D_n$ represents number based median diameter (in μm).

Circularity is preferably 0.945-0.998, but is more preferably 0.955-0.984.

As used herein, "circularity" is the value represented by the formula below. In the formula below, "equivalent circle" refers to a circle having the same area as the projective area of a toner particle, while "circle equivalent diameter" refers to the diameter of the above equivalent circle.

Incidentally, it is possible to determine the above circularity employing "FPIA-2000", produced by Sysmex Corp.

Formula Circularity=(periphery of equivalent circle)/(periphery of projective image of toner particle)= $2\lambda\times$(projective area of particle/$\pi$)$^{1/2}$/(periphery of projective image of toner particle)

Further, in order to minimal maintain heat energy required to fix images to be, the softening point of the toner is preferably in the range of 85-120° C., but is more preferably in the range of 88-100° C., while the melting point of releasing agents of the toner is preferably 58-98° C. As used herein, "melting point of releasing agents" refers to the temperature of the maximum endothermic peak in the second heat determination after raising the temperature from 0° C. to 100° C. and temporarily cooling, employing a differential scanning calorimeter "DSC7", produced by Perkin-Elmer Corp.

It is possible to suitably employ toner, which is prepared employing the above production methods, as a toner which constitutes an electrostatic developer in the electrophotographic fixing method disclosed, for example, in JP-A No. 10-46498. In such an electrophotographic fixing method, it is possible to employ a prior art heating roller system which interposes a transfer material via a heating roller and a pressure roller, as well as a belt fixing system composed of a looped belt which incorporates a heating roller or a pressure roller, each of which rotates freely.

Of belt fixing systems, specifically preferred are systems disclosed in JP-A Nos. 60-86574, 60-104982, and 2-39269. The reasons are that by setting fixing pressure and fixing temperature at a relatively low value, sizing materials of non-image portions are generally not subjected to deterioration.

EXAMPLES

Examples of the present invention will now be described.

Example 1

In Example 1, a coalescence toner was produced employing the toner production apparatus constituted as shown in FIG. 6.

(1-1) Polymerization Process (1) Formation of Nucleus Particles (First Stage Polymerization)

A surface active agent solution (being a water based medium) was prepared by dissolving 7.08 parts by weight of sodium dodecylsulfate in 3,010 parts by weight of ion-exchanged water, and while stirring at a rate of 230 rpm, the interior temperature was raised to 80° C.

Added to the resulting surface active agent solution was an initiator solution prepared by dissolving 9.2 parts by weight of a polymerization initiator (potassium persulfate: KPS) in 200 parts by weight of ion-exchanged water, and the temperature of the resulting mixture was maintained at 75° C. Thereafter, a monomer mixed liquid composition of 0.1 part by weight of styrene, 19.9 parts by weight of n-butyl acrylate, and 10.9 parts by weight of methacrylic acid was dripped over one hour. While stirring, the resulting system was maintained at 75° C. over two hours, whereby a polymerization reaction (a reaction according to the first stage polymerization) was performed and a resinous particle dispersion (hereinafter also referred to as "Resinous Particles (1H)") was prepared.

(2) Formation of Interlayer (Second Stage Polymerization)

Added to a monomer mixed liquid composition of 66.0 parts by weight of poly(n-butyl acrylate) oligomer "ALUFONE 1021" (produced by Toagosei Co., Ltd.) as a fixing aid), 105.6 parts by weight of styrene, 30 parts by weight of n-butyl acrylate, 6.2 parts by weight of methacrylic acid, 5.6 parts by weight of n-octyl-3-mercaptopropionic acid ester were 98.0 parts by weight of pentaerythritol tetrastearic acid ester (at a melting point of 73.0° C.), and dissolved while heated to 90° C., whereby a monomer solution was prepared.

The above monomer solution was added to Resinous Particles (1H) in the reaction tank in an amount of 28 parts by weight in terms of solid conversion and the resulting mixture was continuously stirred at a stirring rate of 460 rpm.

Subsequently, added to the resulting dispersion (the emulsion) were an initiator solution prepared by dissolving 5.1 parts by weight of polymerization initiator (KPS) in 240 parts by weight of ion-exchanged water and 750 parts by weight of ion-exchanged water and by heating and stirring the resulting system at 98° C. for 12 hours, a polymerization reaction (a reaction according to the second stage polymerization) was performed, whereby a composite resinous particle dispersion (hereinafter also referred to as "Resinous Particles (1HM)" was prepared, which were structured in such a manner that the surface of resinous particles composed of high molecular weight resins was covered with medium molecular weight resins incorporating releasing agents (3) Formation of Outer Layer (Third Stage Polymerization)

Added to the above reaction tank, in which resulting Resinous Particles (1HM) were prepared, was an initiator solution prepared by dissolving 7.4 parts by weight of polymerization initiator (KPS) in 200 parts by weight of ion-exchanged water. Subsequently, while maintaining the temperature at 80° C., a monomer mixed solution of 300 parts by weight of styrene, 95 parts by weight of n-butyl acrylate, 15.3 parts by weight of methacrylic acid, and 10.4 parts by weight of n-octyl-mercaptopropionic acid ester was dripped over one hour. Thereafter, while stirring, the resulting system was maintained at 80° C. over two hours, whereby a polymerization reaction (a reaction according to the third stage polymerization) was performed. Thereafter, the resulting system was cooled to 28° C., whereby a dispersion resinous particles (hereinafter also referred to as "Resinous Particles (1H part by weight)" was prepared which were structured in such a manner that the surface of resinous particles composed of high molecular weight resins and further, the surface of the interlayer composed of intermediate molecular weight resins is covered with low molecular weight resins.

"Resinous Particles (1H part by weight)" were dried and the determined softening point was 89.5° C., which corresponded to the melting point of the releasing agent and the peak was 73.0° C.

(1-2) Preparation of Colorant Dispersion

While stirring, 59.0 parts by weight of sodium dodecylsulfate (being an anionic surface active agent) were dissolved in 1,600 parts by weight of ion-exchanged water. While stirring the resulting solution, 420.0 parts by weight of carbon black, "REGAL 330R" (produced by Cabot Co.) were gradually added and subsequently, the resulting mixture was dispersed employing a mechanical homogenizer, "CLEAR MIX" (produced by M Technique Co.), whereby a colorant particle dispersion (hereinafter referred to as "Colorant Dispersion (1)") was prepared.

The diameter of colorant particles in the resulting Colorant-Dispersion (1) was determined employing an electrophoretic light scattering spectrophotometer, "ELS-800" (produced by Otsuka Electronics Co., Ltd.), resulting in a weight average particle diameter of 89 nm.

(2-1) Introduction into Toner Channel

Introduction of the colorant dispersion in the reaction tank into the toner channel was initiated so that the above colorant dispersion merged with a coagulant solution just under the charging inlet of the coagulant solution. An aqueous sodium hydroxide solution was added at double rate with respect to that of resinous particle dispersion from a dilution water tank located downstream from the reaction tank, and the pH was controlled to 10. During this operation, the flow rate was 0.010 m/second. The flow rate of the resinous particle dispersion just before the charging inlet of the coagulant solution was controlled to 0.89 weight parts/second in terms of solids, while the flow rate of the colorant dispersion was controlled to 0.11 weight parts/second.

(2-2) Dripping of Coagulant Solution

Into the coagulant solution tank, previously charged was an aqueous solution prepared by dissolving 12.1 parts by weight of magnesium chloride hexahydrate in 1,000 parts by weight of ion-exchanged water, and was continuously dripped into the dispersion mixture of the resinous particle dispersion with the colorant dispersion at a rate of 0.67 weight part/second.

(2-3) Aggregation Process

Four heating zones were arranged prior to the termination agent solution tank. The first zone (6 m) was controlled at 30° C., and the second zone (6 m) was controlled at 60° C., while the third zone (6 m) was controlled at 90° C. After passing the fourth zone, the diameter of coalesced particles of the dispersion sample was determined employing "COULTER COUNTER TA-11", whereby it was confirmed that the number based median diameter reached 5.2 μm.

(2-4) Dripping of Termination Agent Solution

An aqueous solution prepared by dissolving 80.4 parts by weight of sodium chloride in one part by weight of ion-exchanged water was previously charged in a termination agent solution tank, and was continuously dripped at a rate of 0.43 weight parts/second.

(2-5) Shape Controlling Process

In a shape controlling process region, 30 6-meter zones were connected. Initially, passage was performed through channels, all of which were controlled at 95° C. During this operation, the flow rate of the toner particle dispersion was controlled to reach 0.020 m/second employing a valve, not shown. The targeted circularity of the particle was 0.9605-0.9614. However, since the monitoring result of a sampled dispersion showed that the targeted circularity was achieved in the 26th zone, the 27th zone was controlled at 60° C., while the 28th-30th zones were controlled to 30° C. Incidentally, the toner dispersion which had passed prior to temperature stabilization was collected from the tank through a drain, not shown, and discarded.

(2-6) Solid-Liquid Separation and Drying Process

Washing was repeated employing ion-exchanged water at 35° C. while using a centrifugal dehydrator. Thereafter, drying was performed employing an air flow at 40° C., whereby colored particles (hereinafter also referred to as "Colored Particles (K1)") were obtained.

(2-7) External Additive Adding Process

Added to 100 parts by weight of the dried colored particles were 0.6 part by weight of silica particles at an average primary particle diameter of 12 nm, the surface of which was covered with hexamethyldisilazane and 0.8 part by weight of titanium dioxide particles at an average primary particles diameter of 100 nm, the surface of which was covered with n-octylsilane. The resulting mixture was blended for 15 minutes at a peripheral rate of 35 m/second of the stirring blade of a Henschel mixer, and external additives adding process was performed. The resulting toner was designated as "Toner (1)".

The softening point of produced Toner (1) was 92.4° C., while the melting point of the releasing agent was 73.0° C. The volume based median diameter was 5.6 μm, and the number based median diameter was 5.0 μm, while the variation coefficient of the number based distribution was 20.1 percent. The number based distribution of less than 2 μm was 0.1 percent, while the number based distribution of at least 15 was 0 percent.

As used herein, "softening point" refers to the value which was obtained via determination employing a flow tester. Specifically, a flow tester (at a major diameter of 1 mm) was employed, and at 20° C. and 50 percent relative humidity, pellet-shaped samples of a diameter of 10 mm and a length of 12 mm, which were made from the toner particles, were heated to 80° C. for 300 seconds. Thereafter, at the determination conditions of a load of 200 N and a temperature increasing rate of 6° C./minute, the softening point is the temperature when the outflow reaches 5 mm, determined based on the relationship between the temperature and the outflow.

Comparative Example 1

Charged into a reaction vessel (a four-necked flask) fitted with a thermal sensor, a cooling pipe, a nitrogen inletting device, and a stirrer were 420.7 parts by weight (in terms of solids) of a latex (1H parts by weight), 900 parts by weight of ion-exchanged water, and 166 parts by weight of Colored Dispersion (1). After controlling the interior temperature to 30° C., the pH of the resulting dispersion mixed liquid was adjusted to 10.0 by the addition of a 5N aqueous sodium hydroxide solution. Subsequently, while stirring, an aqueous solution prepared by dissolving 12.1 parts by weight of magnesium chloride hexahydrate in 1,000 parts by weight of ion-exchanged water was added at 30° C. over 10 minutes. After being allowed to stand for three minutes, the temperature was increased and the temperature of this coalescence system was increased to 90° C. over 10 minutes. Under such a state, the diameter of coalesced particles was determined employing "COULTER COUNTER TA-11", and when the number based median diameter reached 5.2 μm, particle growth was terminated by the addition of an aqueous solution prepared by dissolving 80.4 parts by weight of sodium chloride in 1,000 parts by weight of ion-exchanged water. Further, the resulting mixture was stirred at a liquid composition temperature of 95° C. over 5 hours, and sampling was performed periodically. After controlling shape so that the targeted circularity of 0.9605-0.9614 was achieved, the resulting system was cooled to 30° C. and stirring was terminated. The formed particles were collected by filtration and washed repeatedly with ion-exchanged water at 45° C. Thereafter, drying was performed by air flow at 40° C., whereby colored particles were obtained. Comparative Toner (1) was obtained by the addition of external additives in the same manner as for Example 1.

Produced Comparative Toner (1) exhibited a softening point of 92.2° C., while the melting point of the releasing agent was 73.0° C. Further, the volume based median diameter was 5.7 μm, the number based median diameter was 5.0 μm, and the variation coefficient of the number based particle size distribution was 22.5 percent, while the number based distribution of less than 2 μm was 0.5 percent and the number based distribution of at least 15 μm was 0 percent.

By employing the techniques according to each of Example 1 and Comparative Example 1, trial toner production was repeated 10 times under a target circularity of 0.9610, whereby shape reproducibility and highlight reproducibility according to the above production method of Example 1 or Comparative Example 1 were evaluated, and cleaning properties related to the resulting toner was also evaluated. Table 1 below shows the results.

The highlight reproducibility and cleaning properties were evaluated employing an electrophotographic copier "bizhub PRO01050" (produced by Konica Minolta Business Technologies Inc.), while cleaning properties were evaluated employing one sheet of "bizhub PRO1050" as a blade.

TABLE 1

| | Example 1 | Comparative Example 1 |
|---|---|---|
| Shape Reproducibility | A | D |
| Highlight Reproducibility | A | C |
| Cleaning Properties | A | C |

In Table 1, the shape reproducibility was evaluated based on the magnitude of the difference between the maximum and minimum circularity values. Specifically, the case, in which the difference between the maximum value and minimum values was at most 0.0002 and the circularity was in the range of 0.9605-0.9614, was evaluated as A; the case, in which the difference between the maximum value and minimum values was 0.0002-0.0004 and the circularity was in the range of 0.9605-0.9614, was evaluated as B; the case in which the difference between the maximum and minimum values was 0.0004-0.0007 and the circularity was in the range of 0.9605-0.9614, was evaluated as C; while the case, in which a lot was produced which exhibited the difference between the maximum value and minimum vales of at least 0.0008 and exhibited a circularity beyond the range of 0.9605-0.9614, was evaluated as D.

Herein, when the difference between the minimum and maximum values is between 0.0004 and 0.0007 and the circularity is in the range of 0.9605-0.9614, it is difficult to detect any difference in image quality even though a toner lot is changed. Further, cleaning properties are stabilized and durability of cleaning members is enhanced.

Further, the highlight reproducibility was evaluated as follows. Multi-level images at an image area ratio of 5 and 10 percent were formed, and the resulting images were visually observed, and graininess of the highlight portions was evaluated. In practice, the case, in which in all lots, the graininess of both 5 and 10 percent was excellent, was evaluated as A; the case in which at most 3 lots were produced in which the graininess of 5 percent was slightly degraded, but overall graininess was acceptable, was evaluated as B.; and the case in which 4-8 lots were produced in which the graininess of 5 percent was poor, was evaluated as C; while the case in which in all lots, graininess of both 5 and 10 percent was poor, was evaluated as D. Incidentally, A and B were designated to be within the commercially viable range.

Further, cleaning properties were evaluated by determining the number of sheets which resulted in insufficient cleaning. In practice, the case, in which in every lot, it was possible to perform at least 2,000,000 prints, was rated as A, the case, in which prior to performing 2,000,000 prints, at most three lots resulted in slight insufficient cleaning, but durability reached 1,500,000 prints, was rated as B; and the case, in which prior to performing 2,000,000 prints, at most 5 lots resulted in slight insufficient cleaning but durability reached 1,500,000 prints, was rated as C; while the case in which in every lot, durability did not reach 1,500,000 prints, was rated as D.

According to the toner production method of the present invention, the shape of toner particles is controlled in a toner channel which has a shape controlling process region to control the shape of toner particles and is arranged with a temperature controlling device capable of controlling at least two temperature zones. Since the shape of toner particles is generally determined based on temperature and stirring force, high reproducibility and excellent cleaning properties are obtained due to the following; by passing a toner particle dispersion through the toner channel in which temperature is set in each zone, heat exchange efficiency is enhanced, thermal energy applied to toner particles does not fluctuate, stirring energy applied to toner particles is not fluctuated by performing stirring, employing a large reaction tank and large stirring blades, and further, the heat exchange ratio is high, and the heating and cooling rate is easily controlled resulting in stability. Even when used as a non-magnetic single-component developer, stable electrification property is exhibited, image density and contrast are stabalized and particularly, reproducibility of highlight portions is improved. Accordingly, it is possible to produce a toner capable of consistently producing high quality images.

Further, since each zone is maintained at a specified temperature, an apparatus itself is not required to be subjected to heating and cooling cycles as jacket heating of a reaction apparatus (a reaction tank), whereby it is possible to achieve energy conservation.

What is claimed is:

1. A toner production method comprising the steps of:

coalescing resinous particles from a water based medium of a resinous particle dispersion to form toner particles in a coalescing region of a toner channel, the coalescing region having at least two temperature coalescing zones, each of the temperature coalescing zones positioned serially along a flow direction of the toner channel in the coalescing region;

shape-controlling of the toner particles in the water based medium in a shape-controlling region of the toner channel, the shape-controlling region downstream of the coalescing region in the toner channel, the shape-controlling region having at least two temperature shape-controlling zones, each of the temperature shape-controlling zones positioned serially along the flow direction of the toner channel in the shape-controlling region; and temperature-controlling each of the temperature coalescing zones and each of the temperature shape-controlling zones independently with a temperature controller.

2. A toner production method comprising the steps of:

polymerizing at least a polymerizable monomer and a colorant in a water medium by a polymerizing reaction in a polymerizing region of a toner channel to form resinous particles, the polymerizable monomer and the color fed continuously to the toner channel;

shape-controlling of toner particles formed from the resinous particles in the water medium in a shape-controlling region of the toner channel, the shape-controlling region downstream of the polyrnerizing region in the toner channel, the shape-controlling region having at least two temperature shape-controlling zones, each of the temperature shape-controlling zones positioned serially along a flow direction of the toner channel in the shape-controlling region; and temperature-controlling each of the temperature shape-controlling zones independently with a temperature controller.

3. The toner production method of claim 2, wherein the polymerizing region has at least two temperature polymerizing zones, each of the temperature polymerizing zones positioned serially along the flow direction of the toner channel in the olymerizing region, and the temperature controller independently controls each of the temperature polymerization zones.

4. The toner production method of claim 1, further comprising the step of polymerizing at least a polymerizable monomer in the water medium by a polymerization reaction in a polymerizing region of the toner channel to form the resinous particles, the polymerizable monomer fed continuously to the toner channel, and the polymerizing region upstream of the coalescing region in the toner channel.

5. The toner production method of claim 4, wherein the polymerizing region has at least two temperature polymerizing zones each of the temperature polymerizing zones positioned serially along the flow direction of the toner channel in the polymerizing region, and the temperature controller independently controls each of the temperature polymerization zones.

6. The toner production method of claim 4, further comprising the step of at least continuously feeding a pigment into the toner channel between the polymerizing region and the coalescing region.

7. The toner production method of claim 1, wherein the further comprising the step of feeding an aggregation inhibiting agent into the toner channel between the coalescing region and the shape-controlling region.

8. The toner production method of claim 1, wherein the toner channel branches into a plurality of parallel channels and the branched parallel channels subsequently merge.

9. The toner production method of claim 1, wherein the toner channel, which spirally extends in a centripetal direction, is double-spirally arranged with a heating medium passing channel which is adjacent to the toner channel via a spacer which extends in the centrifugal direction.

10. The toner production method of claim 1, wherein in the shape-controlling region of the toner channel, a sampling device is positioned to measure particle diameter and shape coefficient and the temperature of the temperature coalescing zone and the temperature shape-controlling zone is controlled based on the measured results of the particle diameter and the shape coefficients, employing the temperature controller.

11. A toner production apparatus comprising:

a shape controller which controls a shape of toner particles;

a shape-controlling region provided on the shape controller to control the shape of toner particles in a water based medium;

a toner channel for the toner particles which is provided in the shape-controlling region; and a temperature controller for independently controlling at least two temperature shape-controlling zones in the shape-controlling region each of the temperature shape-controlling zones positioned serially along the flow direction of the toner channel in the shape controlling region.

* * * * *